US005946726A

United States Patent [19]

Green

[11] Patent Number: 5,946,726

[45] Date of Patent: Sep. 7, 1999

[54] SPORT TOP WITH INTERIOR BUST SUPPORT

[76] Inventor: Margaret R. Green, 488 7th Ave. Ste. 3A, New York, N.Y. 10018

[21] Appl. No.: 09/086,918

[22] Filed: May 29, 1998

[51] Int. Cl.[6] ..... A41B 9/00; A41C 3/08

[52] U.S. Cl. ..... 2/109; 2/106; 2/102; 450/31

[58] Field of Search ..... 2/109, 102, 103, 2/106, 107, 112, 110, 73, 118, 119; 450/30, 31, 32, 33, 34

[56] References Cited

U.S. PATENT DOCUMENTS

| | | |
|---|---|---|
| 1,254,043 | 1/1918 | James . |
| 2,863,460 | 12/1958 | Monroe . |
| 4,372,320 | 2/1983 | Silber . |
| 4,440,174 | 4/1984 | Cordova . |
| 4,453,274 | 6/1984 | Allen . |
| 4,564,015 | 1/1986 | Friedman . |
| 4,625,338 | 12/1986 | Starling . |
| 4,741,719 | 5/1988 | Wirth . |
| 4,797,954 | 1/1989 | Williams et al. . |
| 4,798,557 | 1/1989 | Scott . |
| 5,033,986 | 7/1991 | Feigenbaum et al. . |
| 5,267,352 | 12/1993 | Rodarmel . |
| 5,678,246 | 10/1997 | Cooley et al. . |
| 5,685,764 | 11/1997 | Kostritzky . |

*Primary Examiner*—John J. Calvert
*Assistant Examiner*—Shirra L. Jenkins
*Attorney, Agent, or Firm*—Brown Raysman Millstein Felder & Steiner LLP

[57] ABSTRACT

A woman's sport top with interior bust support is provided. The bust support is provided by two interior bust support sections fastened to opposite sides of the inside of an outer fabric and detachably connected together. Fastening means in the center of the front of both the interior bust support and the outer fabric allow the sport top to be opened and closed easily and comfortably in the front of the garment.

23 Claims, 10 Drawing Sheets

SPORT TOP WITH INTERIOR BUST SUPPORT

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

The invention disclosed herein relates generally to articles of clothing with bust support. More particularly, the present invention relates to a woman's sport top with interior bust support.

The development of spandex by various fiber mills (e.g., Lycra-brand spandex, available from E. I. du Pont de Nemours and Company, Wilmington, Del.) has promoted the use of spandex in fabrics for various garments. By varying the amount of spandex used in combination with other fibers in a fabric, a fabric manufacturer is able to vary the degree of stretch of the fabric.

This has allowed apparel manufacturers to design, construct, and market garments which are body-conscious (form-fitting) and allow for movement, stretch, comfort, ease of entry, and the wicking away of moisture.

In general, garment tops worn by women during exercise and sporting activities are designed to be comfortable to wear. The comfort of the garment top limits the amount of bust support that the garment top can provide to the wearer. This often means that female athletes need to wear a bra (regular bra, athletic bra, or sports bra) in addition to the outer garment top in order to provide comfort and support to the breasts and surrounding muscle and tissue. This is uncomfortable and inconvenient for the wearer because it increases the number of garments worn.

Further, the two garments (e.g., a spandex-containing top and a bra) are often uncomfortable when worn together because the various straps, zippers, clasps, and the like, which may be on the bra, may interfere with those straps, zippers, clasps, and the like, which are on the outer garment. The pressure of a tight-fitting outer garment may also press the bra's straps against the body, increasing the discomfort. In addition, the bra may not fashionably coordinate with the outer garment. Further, the outer garment may not provide adequate coverage of the bra's straps.

There is thus a need for a sport top which is comfortable, fashionable, and provides adequate bust support to the wearer while allowing for freedom of movement, stretching, ease of entry, and wicking away of moisture.

BRIEF SUMMARY OF THE INVENTION

It is an object of the present invention to provide a sport top for a woman which provides bust support.

It is another object of the present invention to provide a sport top for a woman which provides adequate bust support for the woman while she is engaged in sports, exercises, and other physically demanding activities.

It is another object of the present invention to provide a sport top for a woman which has comfortable built-in bust support.

It is another object of the present invention to provide a sport top for a woman which has built-in bust support adequate for the woman to comfortably engage in sports, exercises, and other physically demanding activities and which is made from commercially available fabrics.

It is another object of the present invention to provide a sport top for a woman which supplies all properties for top athletic performance, including comfort, movement, support, and control, as well as adequate bust support.

The above and other objects are achieved by a sport top for a woman which covers at least part of the wearer's torso, has openings for the wearer's arms and neck, and has built-in bust support. The bust support is supplied by an inner bust support portion which has a left section and a right section, corresponding to the anatomy of the female body. The left and right sections hold and support the breasts and the surrounding muscle and tissue and are attached to the outer fabric at the side seams, along the front armhole seams, and at the shoulder seams of the outer fabric. The left and right bust support sections are detachably connected to each other with a clasp or other fastening device. The outer fabric which forms the sport top opens and closes in the front through the use of buttons, a zipper, or other fastening device. The sport top is useful for professional, collegiate, weekend, and occasional female athletes.

BRIEF DESCRIPTION OF THE DRAWINGS

The invention is illustrated in the figures of the accompanying drawings which are meant to be exemplary and not limiting, in which like references refer to like or corresponding parts, and in which.

DETAILED DESCRIPTION OF THE PREFERRED EMBODIMENTS

Figure 1:
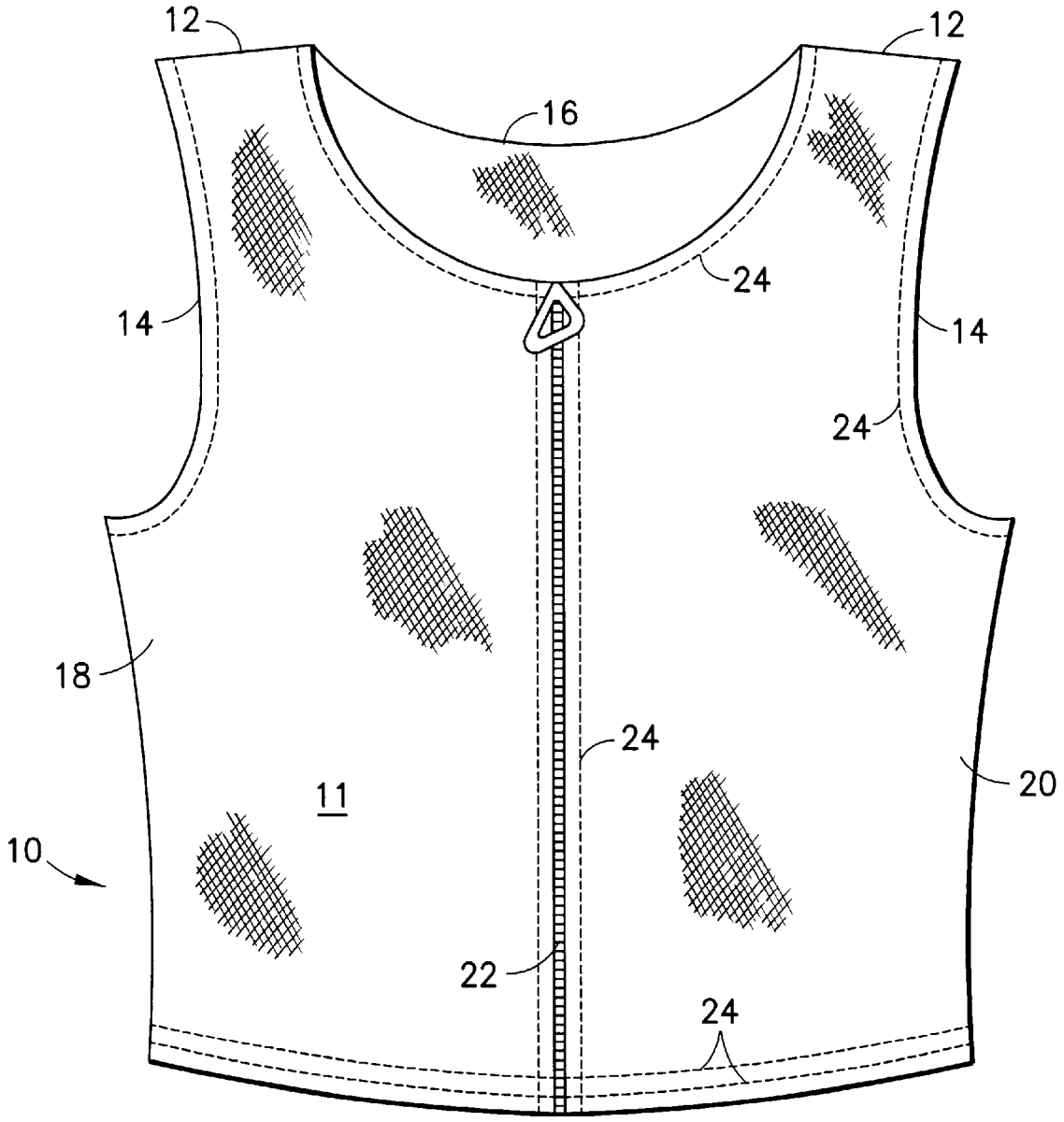
FIG. 1 is a front view of a preferred embodiment of the present invention with the outer fabric connected.
Figure 3:
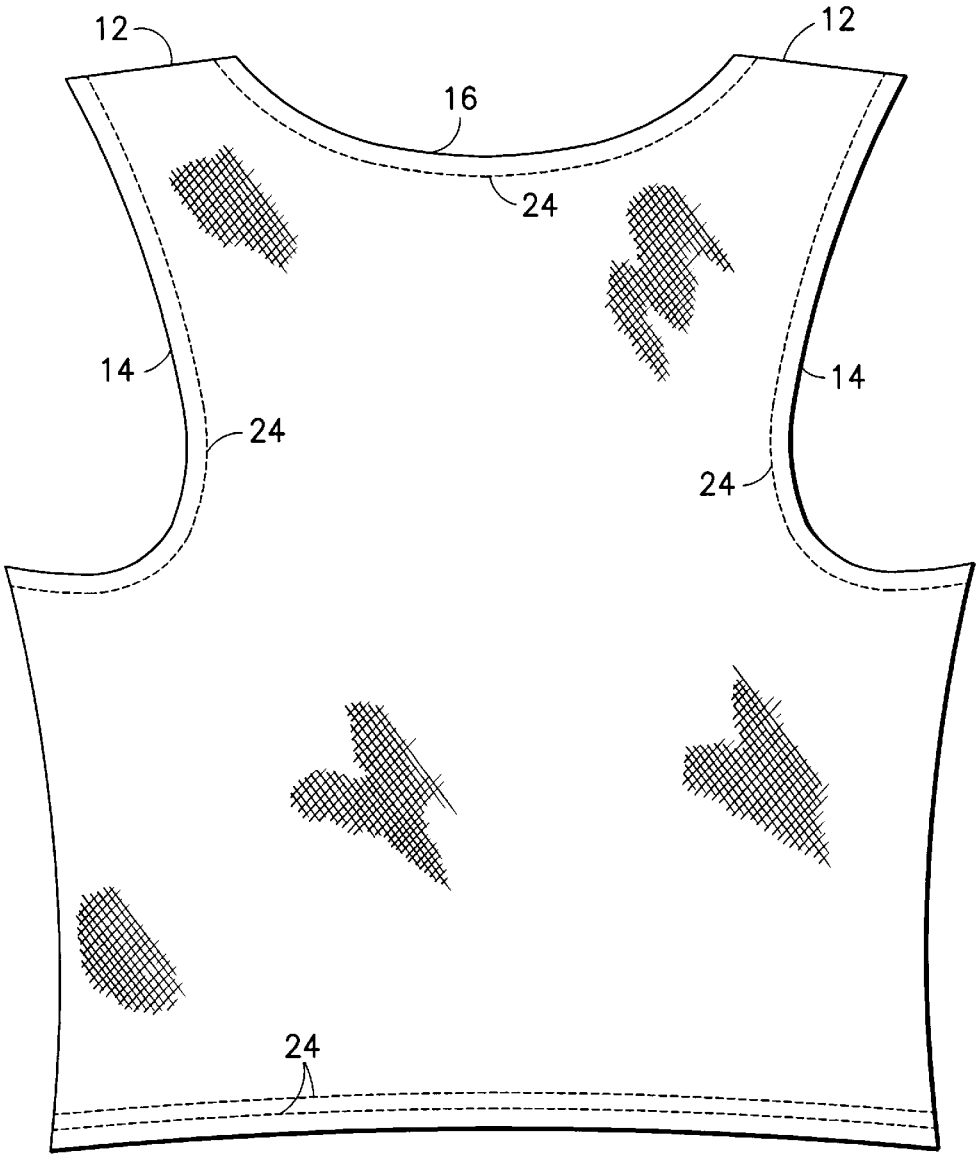
FIG. 3 is a back view of a preferred embodiment of the present invention.
Figure 4:
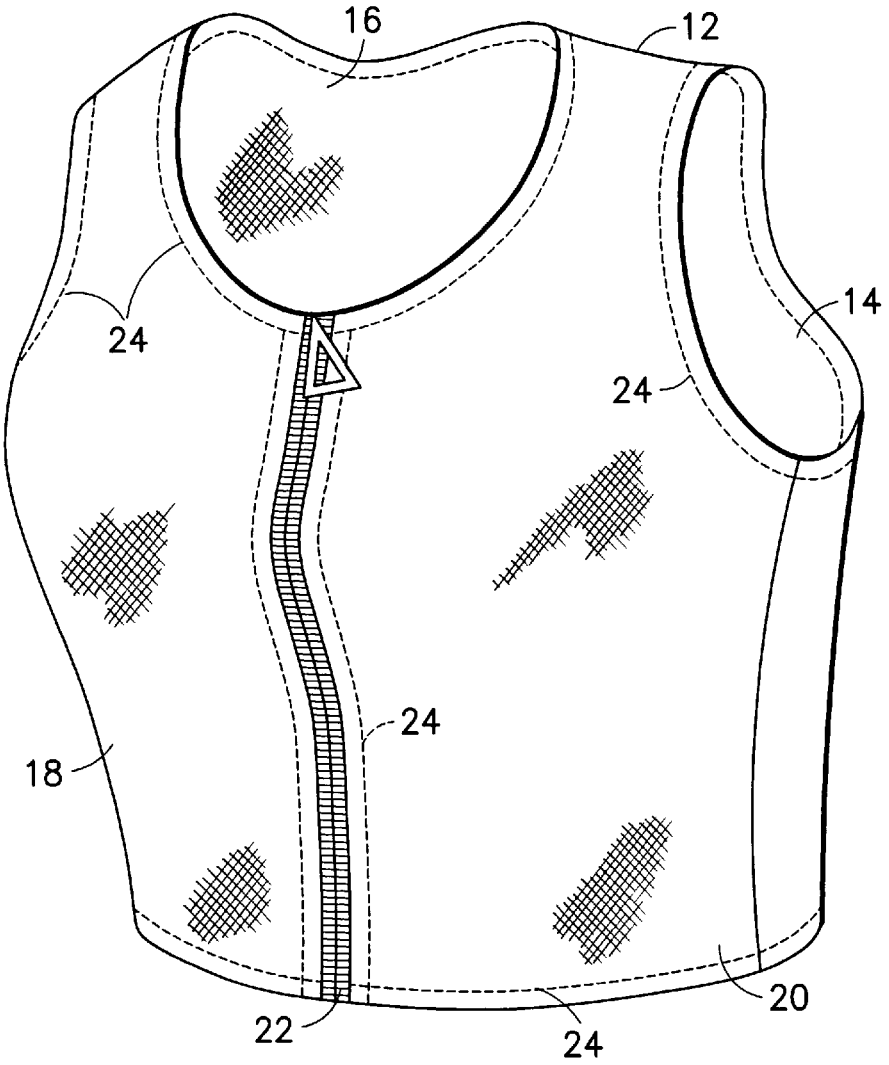
FIG. 4 is a left perspective view of a preferred embodiment of the present invention.

A front view of a preferred embodiment of the invention is depicted in FIG. 1 in a front view of the sport top 10. A back view is shown in FIG. 3 and a perspective view in FIG. 4. The sport top 10 may be made for use in various activities, such as playing sports, exercising, or other physically demanding activities. Sport top 10 includes an outer fabric 11 which encloses at least the bust portion of a woman's torso. Sport top 10 includes shoulder areas 12 extending between arm holes 14 and a neck opening 16. Although the sport top 10 shown in FIG. 1 is sleeveless, short or long sleeves may be added.

The two front portions 18 and 20 of the outer fabric are detachably connected with conventional fastening means, such as a zipper 22, a series of buttons or snaps, or Velcro or hook and loop type fastener. The dotted lines 24 extending around the bottom of the sport top 10, the arm holes 14, the neck opening 16, and along the zipper 22, represent finishing seams of the sport top. The seams 24 extending around the arm holes 14 and neck hole 16 connect the end of the fabric folded back with an elastic band contained within the finishing seams to increase tension in those areas and make the sport top more fitting. The elastic band is approximately ⅜ of an inch in width.

Figure 2A:
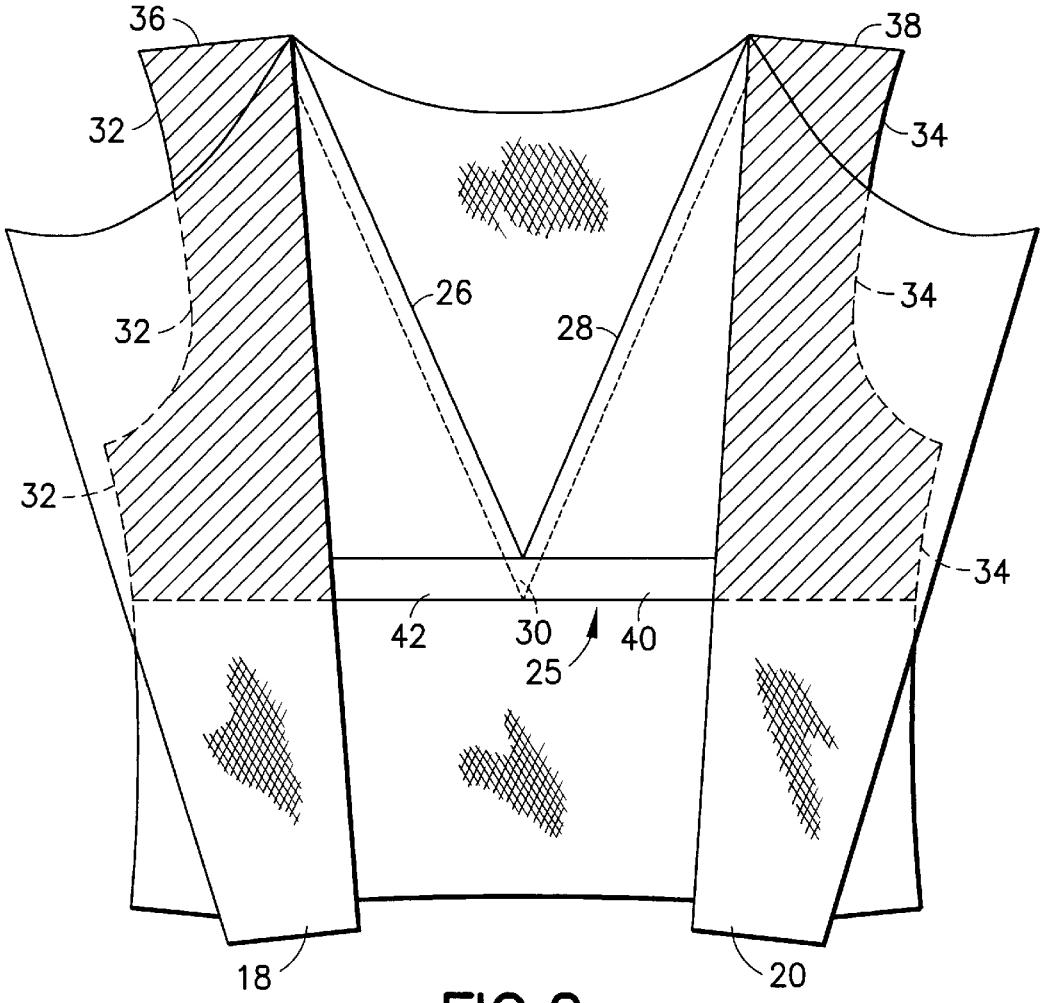
FIG. 2*a* is a front view of a preferred embodiment of the present invention with the outer fabric open to show the inner bust support portion, wherein the inner bust support comprises two sections of fabric detachably connected at the front center, and showing the areas of attachment of the inner bust support sections to the inside of the outer fabric.

Referring to FIG. 2*a*, showing the outer fabric open and the portion behind the open outer fabric shown in cut-away, the inner bust support portion 25 is formed by two fabric sections 26 and 28. Such a configuration, corresponding to a shelf bra, is preferred when the wearer is small-breasted or the wearer is undertaking low-impact activities. The adjacent edges of the fabric sections 26 and 28 are detachably connected, as with a plastic clasp 30, Velcro, a button, a snap, or other conventional connector. The opposite longitudinal edges 32, 34 of the fabric sections 26, 28 are attached to the inside of the two front sections of the outer garment 18, 20. In preferred embodiments, the longitudinal edges 32, 34 are sewn to the outer fabric starting at a point below the arm holes 14 and the bust on the side seam, midway between the front and the back of the outer fabric, and extending continuously up along the front of the arm holes 14 to the shoulder seam, midway between the front and back of the outer fabric. In addition, a top edge 36, 38 of each fabric section 26, 28 is also attached to the shoulder seam on the inside of the front outer sections such as by sewing to the outer fabric along the shoulder portion 12 extending between the top of each arm hole 14 and the start of the neck opening 16 at the midpoint between front and back of the outer fabric. As a result, in preferred embodiments, edges of the fabric sections 26, 28 are continuously attached to the inside of the outer front fabric from below the bust region up to the neck opening 16, thus providing strength and support for the sections 26, 28. Fabric sections 26 and 28 may be shaped to follow the contours of the bust as by, for example, heat molding polynylon or other fabric on a bust shaped mold.

Figure 2B:
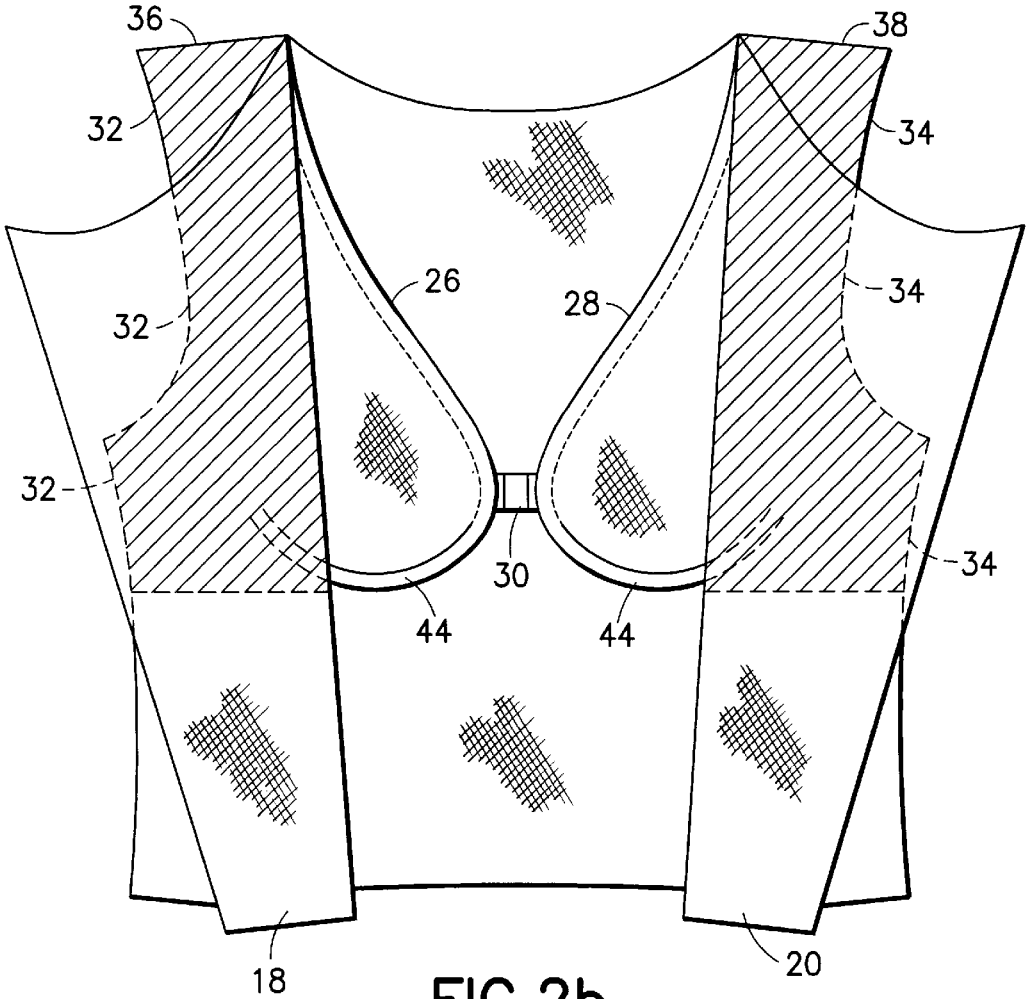
FIG. 2*b* is a front view of a preferred embodiment of the present invention with the outer fabric open to show the inner bust support portion, wherein the inner bust support comprises two sections of fabric having underwire supports in each section, and showing the areas of attachment of the inner bust support portion sections to the inside of the outer fabric.

Referring to FIG. 2*b*, fabric sections 26 and 28 may contain underwire supports 44 attached to the fabric sections 26, 28 for additional bust support. Such a configuration, corresponding to an underwire bra, is preferred when the wearer is medium-breasted or when the wearer is undertaking moderately strenuous physical activities.

Figure 2C:
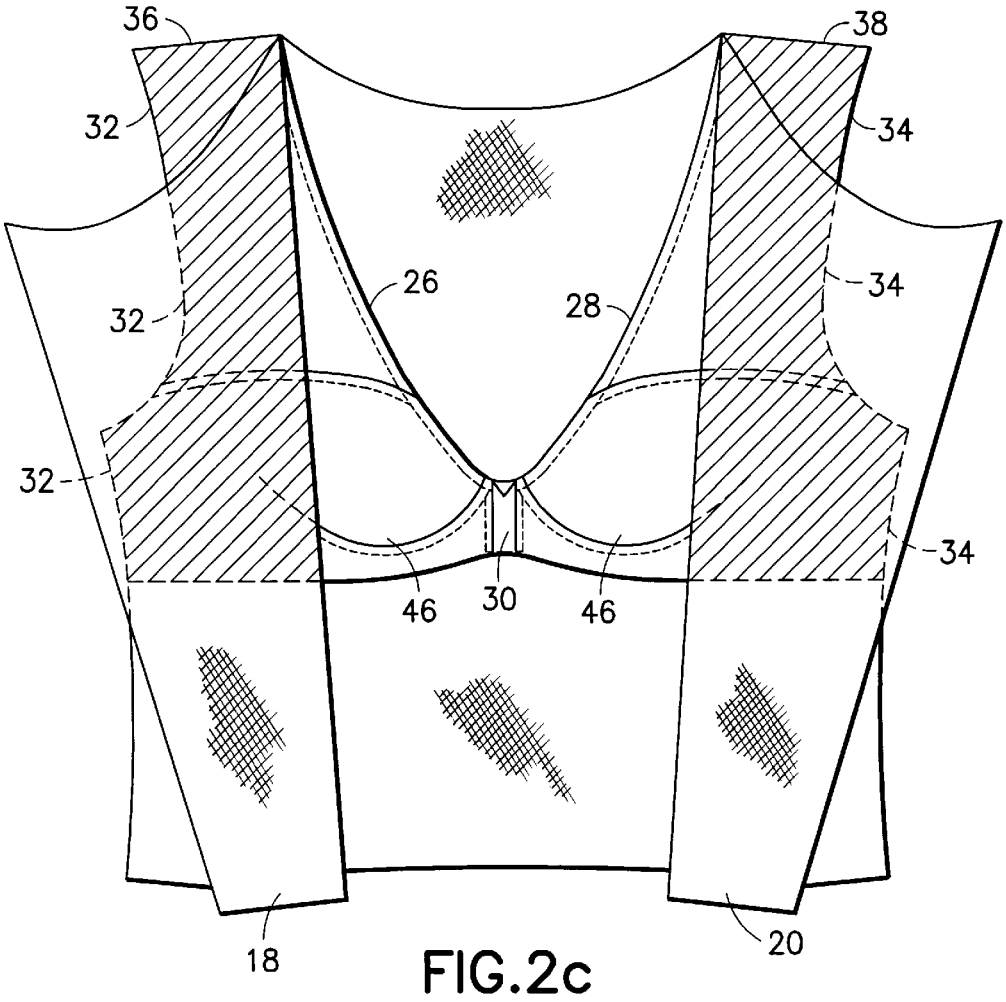
FIG. 2*c* is a front view of a preferred embodiment of the present invention with the outer fabric open to show the inner bust support portion, wherein the inner bust support portion comprises two sections of fabric having molded breast cups attached to each section, and showing the areas of attachment of the inner bust support sections to the inside of the outer fabric.

Referring to FIG. 2*c*, fabric sections 26 and 28 may be attached to breast cups 46 shaped to conform to the contours of a woman's bust. Such a configuration, corresponding to a cup bra, is preferred when the wearer is large-breasted or when the wearer is undertaking high impact activities.

Figure 5:
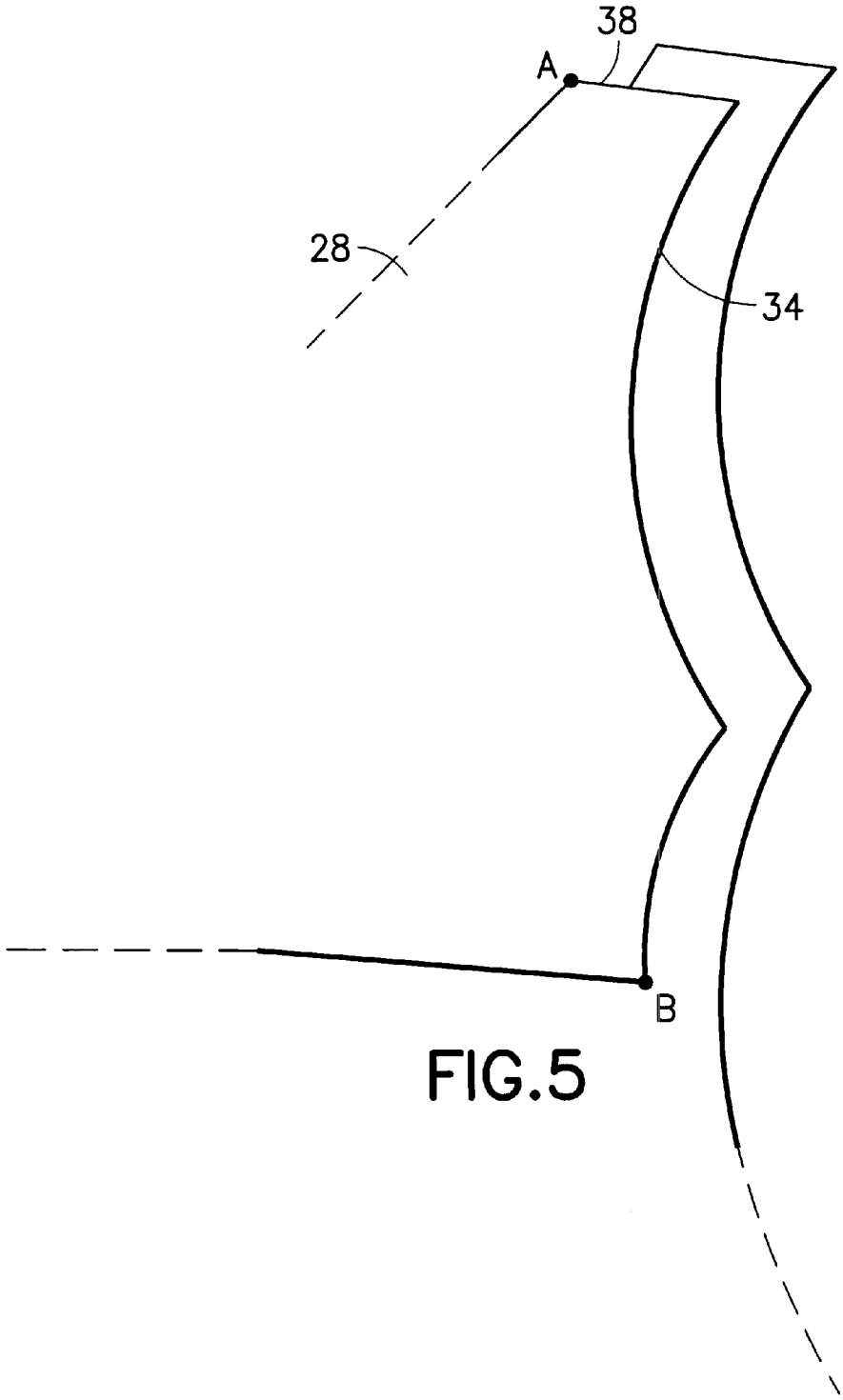
FIG. 5 is a partial exploded view of the preferred embodiment showing the connection between a section of the outer fabric and the bust support portion.
Figure 6A:
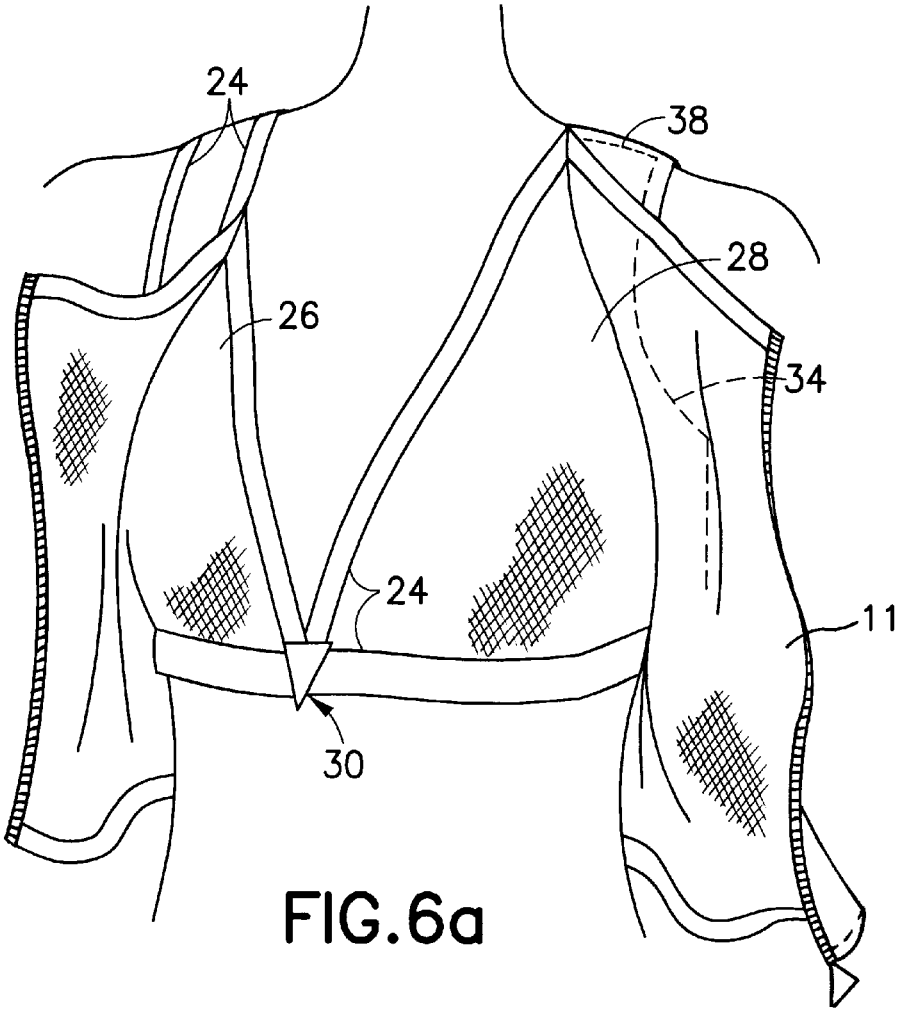
FIG. 6*a* is a front perspective of the present invention depicted as worn with the outer fabric open to show the inner bust support portion, wherein the inner bust support portion comprises two sections of fabric detachably connected at the front center.
Figure 6B:
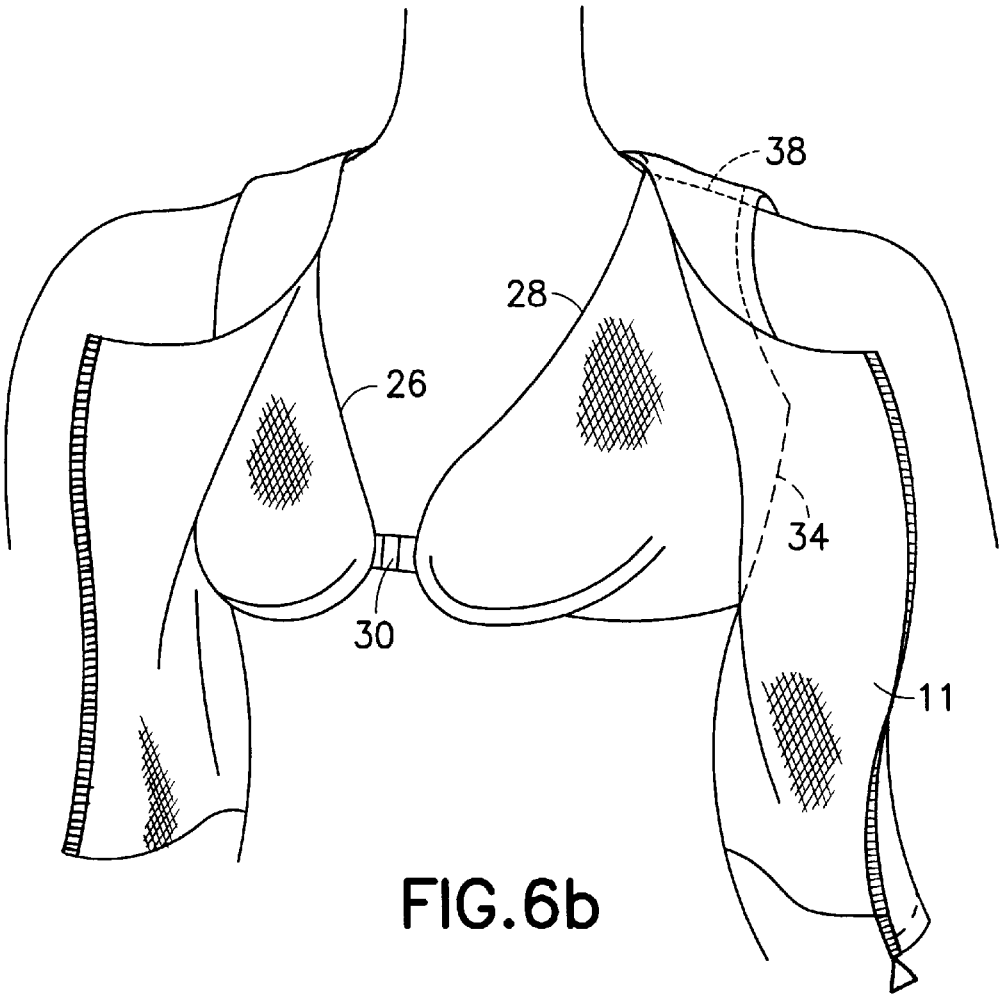
FIG. 6*b* is a front perspective of the present invention depicted as worn with the outer fabric open to show the inner bust support portion, wherein the inner bust support portion comprises two sections of fabric with underwire supports in each section.
Figure 6C:
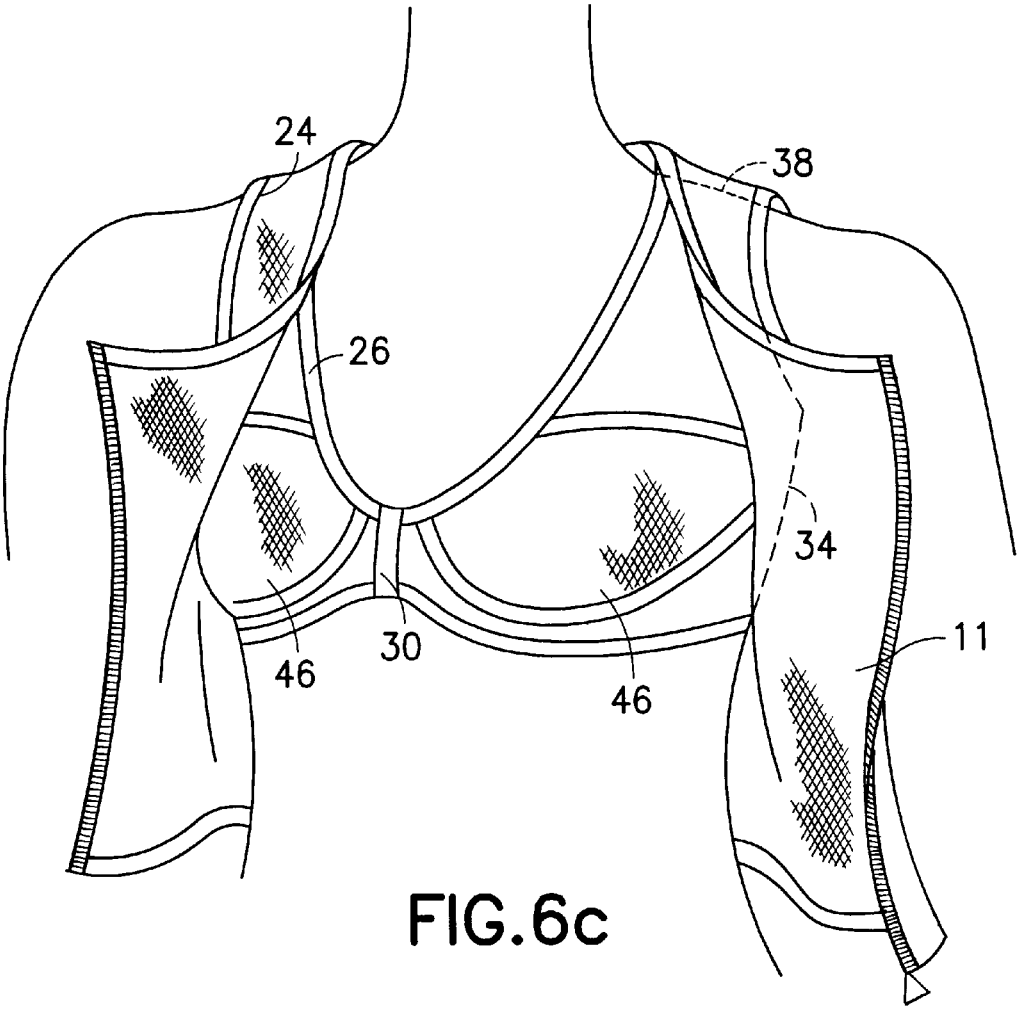
FIG. 6*c* is a front perspective of the present invention depicted as worn with the outer fabric open to show the inner bust support portion, wherein the inner bust support portion comprises two sections of fabric with molded breast cups attached to each section.

FIG. 5 shows in exploded view the connection between the two edges 34, 38 of the fabric section 28 (shown in part) and the inside edges of the outer fabric (shown in part), extending from point A in FIG. 5 to point B. As shown in FIGS. 6*a*, 6*b*, and 6*c*, this connection between the inner sections 26, 28 and outer fabric 11 allows for the inner sections 26, 28 to remain hidden when the outer fabric 11 is closed and for the outer fabric front portions 18, 20 to be almost entirely open while the inner sections 26, 28 remain closed.

In a preferred embodiment of the invention, strips of elastic material 40, 42 (FIG. 2*a*) are attached, such as by sewing, to the inside bottom of each of the inner fabric sections 26 and 28. The elastic straps provide tension to support the bust. In one preferred embodiment of the invention, the strips of elastic material 40, 42 are approximately one inch wide.

The outer fabric may be made of any natural or synthetic fabric suitable for use as a woman's sport top, such as cotton, polyester, nylon, linen, rayon, and blends thereof. In a preferred embodiment, the outer fabric comprises natural or synthetic fibers combined with spandex. The outer fabric of a preferred embodiment of the invention comprises from 2 to 18 volume percent spandex.

The outer fabric may alternatively be made of a fabric suitable for use in cold weather, such that the sport top may be used while snow skiing, snow boarding, ice skating, or participating in other cold-weather activities. Likewise, the outer fabric may be made of a fabric suitable for use in water, such that the sport top may be used while water skiing, operating personal watercraft, diving, swimming, or participating in other aquatic activities. Similarly, the inner fabric sections may be made of a fabric suitable for use in cold weather or of a fabric suitable for use in water.

The outer fabric may be one piece of fabric or may be constructed of multiple pieces attached to each other so as to form interesting and attractive designs. Preferably, the inner and outer fabrics are antimicrobial. In a preferred embodiment of the invention, the outer fabric is made of Supplex-brand nylon, available from E. I. du Pont de Nemours and Company, and Lycra-brand spandex, available from E. I. Du Pont de Nemours and Company. In a preferred embodiment of the invention, the inner fabric sections 26 and 28 are made of Tricott Coolmax-brand fabric, available from E. I. du Pont de Nemours and Company. Of course, one skilled in the art will recognize that other materials may be used, such as cotton, polyester, and other acceptable fibers.

While the invention has been described and illustrated in connection with preferred embodiments, many variations and modifications as will be evident to those skilled in this art may be made without departing from the spirit and scope of the invention, and the invention is thus not to be limited to the precise details of methodology or construction set forth above as such variations and modification are intended to be included within the scope of the invention.

What is claimed is:

1. An upper torso article of clothing having a right arm hole, a left arm hole, and a neck opening, the article of clothing comprising:

an outer fabric extending from the shoulders to a point below the bust; and an inner bust support portion comprising two opposing fabric sections being detachably connectable to one another at a front and said sections extending only along a front of said outer fabric, each fabric section being attached along at least one longitudinal edge thereof to an inside edge of the outer fabric from a point below the bust and extending along an edge of the arm hole extending along the front.

2. The article of clothing of claim 1 wherein each fabric section is continuously attached along at least one longitudinal edge thereof to an inside edge of the outer fabric from a point below the bust and extending along an edge of the arm hole extending along the front.

3. The article of clothing of claim 1 wherein the outer fabric is made of a stretchable natural or synthetic fabric or blends thereof.

4. The article of clothing of claim 1 wherein the outer fabric comprises from approximately 2 to approximately 18 percent volume spandex.

5. The article of clothing of claim 1 wherein the inner bust support portion is made of a stretchable natural or synthetic fabric or blends thereof.

6. The article of clothing of claim 1 wherein the outer fabric is made of a fabric comprising approximately 89 percent volume nylon and approximately 11 percent volume spandex.

7. The article of clothing of claim 1 wherein the inner bust support portion is made of a fabric comprising approximately 100 percent nylon.

8. The article of clothing of claim 1 comprising means for detachably connecting each fabric section to the other.

9. The article of clothing of claim 8 wherein the means for detachably connecting each fabric section to the other comprises a male connector and a female connector.

10. The article of clothing of claim 8 wherein the means for detachably connecting each fabric section to the other comprises hook and loop fasteners.

11. The article of clothing of claim 8 wherein the means for detachably connecting each fabric section to the other is located in the center of the front of the article of clothing.

12. The article of clothing of claim 1 wherein the outer fabric comprises a sleeveless vest.

13. The article of clothing of claim 1 wherein the outer fabric comprises a shirt with sleeves.

14. The article of clothing of claim 1 comprising elastic trim attached to the bottom of each of the two fabric sections.

15. The article of clothing of claim 14 wherein the elastic trim is approximately 1 inch wide.

16. The article of clothing of claim 1 comprising elastic trim attached to the interior of each of the right arm hole and the left arm hole.

17. The article of clothing of claim 1 comprising elastic trim attached to the interior of the neck opening.

18. The article of clothing of claim 1 wherein each of the fabric sections is attached to the outer fabric substantially from the neck opening to one of the arm holes.

19. The article of clothing of claim 1 wherein each of the fabric sections is continuously attached to the outer fabric from the neck opening to one of the arm holes.

20. The article of clothing of claim 19 wherein each of the fabric sections is attached along a shoulder seam of the outer fabric.

21. The article of clothing of claim 1 comprising underwire supports attached to each of the fabric sections.

22. The article of clothing of claim 1 comprising molded breast cups attached to each of the fabric sections.

23. The article of clothing of claim 1 wherein each of the fabric sections is attached along its longitudinal edge to at least part of a side seam of the outer fabric.

* * * * *